US010261538B2

(12) United States Patent
Ono

(10) Patent No.: US 10,261,538 B2
(45) Date of Patent: Apr. 16, 2019

(54) STANDARD VOLTAGE CIRCUIT AND SEMICONDUCTOR INTEGRATED CIRCUIT

(71) Applicant: Toshiba Memory Corporation, Tokyo (JP)

(72) Inventor: Takeshi Ono, Yamato Kanagawa (JP)

(73) Assignee: TOSHIBA MEMORY CORPORATION, Tokyo (JP)

( * ) Notice: Subject to any disclaimer, the term of this patent is extended or adjusted under 35 U.S.C. 154(b) by 0 days.

(21) Appl. No.: 15/694,556

(22) Filed: Sep. 1, 2017

(65) Prior Publication Data

US 2018/0275710 A1 Sep. 27, 2018

(30) Foreign Application Priority Data

Mar. 23, 2017 (JP) ..... 2017-058266

(51) Int. Cl.
*G05F 1/656* (2006.01)
*G05F 3/26* (2006.01)
*G05F 3/30* (2006.01)

(52) U.S. Cl.
CPC ..... *G05F 3/267* (2013.01); *G05F 3/30* (2013.01)

(58) Field of Classification Search
CPC ..... G05F 3/267
See application file for complete search history.

(56) References Cited

U.S. PATENT DOCUMENTS 6,724,176 B1 * 4/2004 Wong ..... G05F 3/30 323/314
2009/0201067 A1 8/2009 Haneda

FOREIGN PATENT DOCUMENTS

JP H109967 A 1/1998
JP 4167122 B2 10/2008

* cited by examiner

*Primary Examiner* — Daniel Puentes
(74) *Attorney, Agent, or Firm* — Kim & Stewart LLP

(57) ABSTRACT

A standard voltage circuit includes an operational amplifier, first and second diodes, a resistance element, and a dummy leak generation circuit. The first diode is electrically connected to a first node of a first line which is disposed on an output terminal side of the operation amplifier and is electrically connected to a first input terminal of the operation amplifier through the first node. The second diode is electrically inserted connected to a second node of a second line which is disposed on the output terminal side of the operation amplifier and is electrically connected to a second input terminal of the operation amplifier through the second node. The resistance element is electrically connected to the second node in series with the second diode. The dummy leak generation circuit is electrically connected to one of the first line and the second line.

16 Claims, 16 Drawing Sheets

STANDARD VOLTAGE CIRCUIT AND SEMICONDUCTOR INTEGRATED CIRCUIT

CROSS-REFERENCE TO RELATED APPLICATION

This application is based upon and claims the benefit of priority from Japanese Patent Application No. 2017-058266, filed Mar. 23, 2017, the entire contents of which are incorporated herein by reference.

FIELD

Embodiments described herein relate generally to a standard voltage circuit and a semiconductor integrated circuit.

BACKGROUND

A standard voltage circuit generates a standard voltage and supplies the standard voltage to a predetermined circuit. At this time, it is desirable that the standard voltage generated by the standard voltage circuit is stable.

DETAILED DESCRIPTION

An embodiment provides a standard voltage circuit and a semiconductor integrated circuit which can stably generate a standard voltage.

In general, according to one embodiment, a standard voltage circuit includes an operational amplifier, first and second diodes, a resistance element, and a dummy leak generation circuit. The first diode is electrically connected to a first node of a first line which is disposed on an output terminal side of the operation amplifier and is electrically connected to a first input terminal of the operation amplifier through the first node. The second diode is electrically inserted connected to a second node of a second line which is disposed on the output terminal side of the operation amplifier and is electrically connected to a second input terminal of the operation amplifier through the second node. The resistance element is electrically connected to the second node in series with the second diode. The dummy leak generation circuit is electrically connected to one of the first line and the second line.

Hereinafter, a standard voltage circuit according to an embodiment is described in detail with reference to the accompanying drawings. Embodiments of the present disclosure are not limiting.

Embodiment

A standard voltage circuit according to an embodiment is described. The standard voltage circuit is provided in a semiconductor integrated circuit and generates a standard voltage serving as a reference for generating a standard voltage as an output voltage in the semiconductor integrated circuit.

Figure 1:
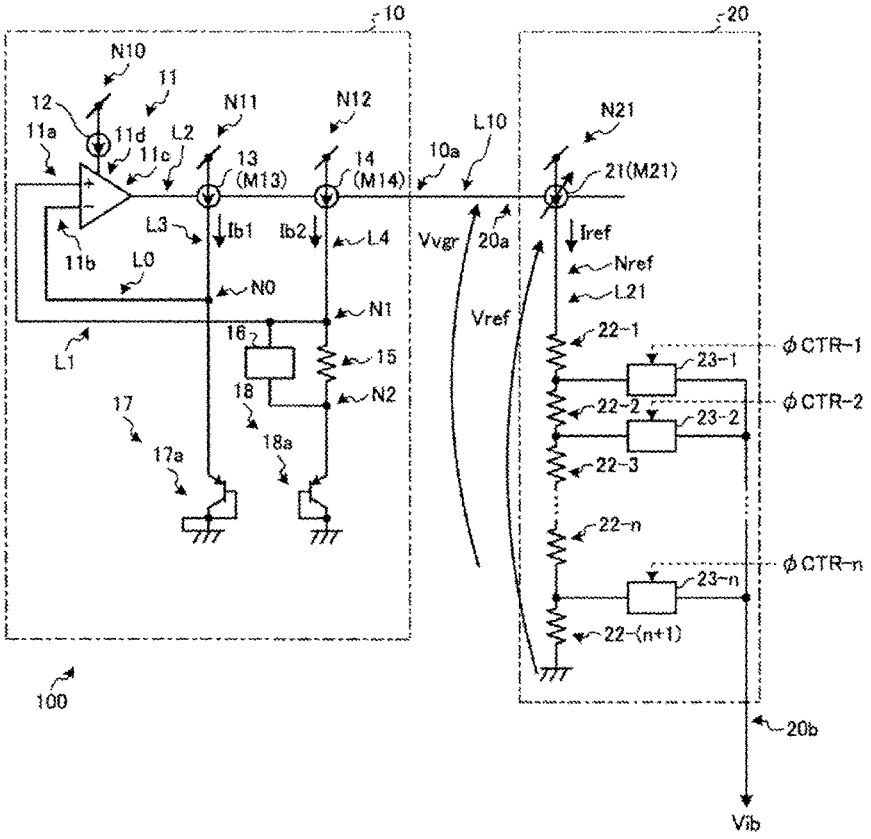
FIG. 1 is a circuit diagram illustrating a configuration of a semiconductor integrated circuit including a standard voltage circuit according to an embodiment.

For example, a semiconductor integrated circuit 100 has a standard voltage circuit 10 and a voltage dividing circuit 20 as illustrated in FIG. 1. FIG. 1 is a circuit diagram illustrating a configuration of the semiconductor integrated circuit 100 including the standard voltage circuit 10.

The standard voltage circuit 10 is a band gap reference circuit which uses a band gap voltage (for example, a forward voltage of a diode) corresponding to band gap energy of a semiconductor. That is, the standard voltage circuit 10 receives a power supply voltage from the outside at a power supply node N10, adjusts a level of the power supply voltage into a level of the standard voltage corresponding to the band gap voltage, and supplies the adjusted standard voltage to a line L10. The standard voltage circuit 10 is connected to the voltage dividing circuit 20 through the line L10. When n is an integer of 2 or more, the voltage dividing circuit 20 can divide a voltage into voltages of n stages in response to control signals ϕCTR-1 to ϕCTR-n from the outside, and a voltage dividing ratio is set by trimming or the like. A reference voltage Vref corresponding to the standard voltage Vvgr generated by the standard voltage circuit 10 is divided in accordance with the voltage dividing ratio set by the voltage dividing circuit 20 and is output to another circuit (for example, another analog circuit) as the standard voltage Vib.

For example, when generating the standard voltage Vib, the voltage dividing circuit 20 divides the reference voltage Vref corresponding to the standard voltage Vvgr received from the standard voltage circuit 10 by using resistance elements 22-1 to 22-($n$+1) and switch circuits 23-1 to 23-$n$ selected by the control signals ϕCTR-1 to ϕCTR-n into desired voltages for use. In the semiconductor integrated circuit 100, the standard voltage Vib easily varies from a desired value as the unselected switch circuits 23-1 to 23-$n$ in the voltage dividing circuit 20 off-leak (leak in an OFF state) at a high temperature. That is, although the variation depending on a temperature of the standard voltage Vvgr generated by the standard voltage circuit 10 is suppressed (refer to characteristics indicated by the dashed line in FIG. 5A), the standard voltage Vib which is divided by the voltage dividing circuit 20 and is output can vary depending on the temperature (refer to characteristics indicated by the dashed line in FIG. 5B). If the standard voltage Vib varies, there is a possibility that characteristics of another circuit (for example, another analog circuit) receiving the standard voltage Vib to operate may deteriorate.

Hence, in the present embodiment, the standard voltage circuit 10 includes a dummy leak generation circuit 16 having the same off-leakage characteristics as the switch circuits 23-1 to 23-$n$, which reduces a temperature variation of the standard voltage Vib output from the voltage dividing circuit 20 by adjusting the standard voltage Vvgr depending on the off-leakage characteristics.

Specifically, the standard voltage circuit 10 includes an operational amplifier 11, a current source 13, a current source 14, a resistance element 15, the dummy leak generation circuit 16, a diode 17, and a diode 18 as illustrated in FIG. 1.

The operational amplifier 11 has a non-inverting input terminal 11$a$, an inverting input terminal 11$b$, an output terminal 11$c$, and a power supply terminal 11$d$. The non-inverting input terminal 11$a$ is connected to a node N1 through a line L1. The inverting input terminal 11$b$ is connected to a node N0 through a line L0. The output terminal 11$c$ is connected to a control node of the current source 13, a control node of the current source 14, and an output node 10$a$ of the standard voltage circuit 10 through a line L2. The power supply terminal 11$d$ is connected to a power supply node N10 through a current source 12.

The current source 13 is electrically inserted between a power supply node N11 and the node N0 in a line L3. The current source 13 includes an input node electrically connected to the power supply node N11, an output node electrically connected to the node N0, and a control node electrically connected to the output terminal 11$c$ of the operational amplifier 11 through the line L2.

The current source 13 receives a bias voltage from the operational amplifier 11 and generates a bias current Ib1 according to the bias voltage. The current source 13 has, for example, a transistor M13, and generates a drain current of the transistor M13 as a bias current Ib1 according to the bias voltage received at a gate of the transistor M13. The current source 13 supplies the generated bias current Ib1 to the node N0.

The diode 17 is electrically inserted between the node N0 and a ground potential. The diode 17 is configured such that a direction from the node N0 to the ground potential becomes a forward direction. The diode 17 has a configuration in which a PNP type bipolar transistor 17$a$ is diode-connected. That is, the bipolar transistor 17$a$ has an emitter connected to the node N0, a base connected to a collector, and the collector connected to the base and the ground potential.

When receiving the bias current Ib1 from the node N0 side, the diode 17 makes the bias current Ib1 flow to the ground potential side in the forward direction. At this time, a potential (≡potential of the node N0) on the node N0 side of the diode 17 becomes a forward voltage (for example, approximately 0.7 V) of the diode 17.

In FIG. 1, for the sake of simple illustration, a configuration in a case where the standard voltage circuit 10 has one diode 17 is exemplified, but the standard voltage circuit 10 may have a plurality (for example, dozens) of the diodes 17. At this time, the plurality of diodes 17 may be electrically inserted in parallel with each other between the node N0 and the ground potential. Thereby, it is possible to equalize the forward voltages of the plurality of diodes 17 so as to be used as the potential on the node N0 side of the diode 17, and to reduce an influence of the variation of the forward voltage of each diode 17 on the potential of the node N0.

The current source 14 is electrically inserted between a power supply node N12 and the node N1 in the line L4. The current source 14 has an input node electrically connected to the power supply node N12, an output node electrically connected to the node N1, and the control node electrically connected to the output terminal 11$c$ of the operational amplifier 11 through the line L2. The current source 14 configures a current mirror circuit together with the current source 13 through the operational amplifier 11.

The current source 14 receives a bias voltage from the operational amplifier 11 and generates a bias current Ib2 according to the bias voltage. The current source 14 has, for example, a transistor M14 and generates a drain current of the transistor M14 as a bias current Ib2 according to the bias voltage received at a gate of the transistor M14. The current source 14 makes the generated bias current Ib2 flow to the node N1.

The diode 18 is electrically inserted between the node N2 and the ground potential. The diode 18 is configured such that a direction from the node N2 to the ground potential becomes a forward direction. The diode 18 has a configuration in which a PNP type bipolar transistor 18$a$ is diode-connected. That is, an emitter of the bipolar transistor 18$a$ is connected to the node N2, a base thereof is connected to a collector thereof, and the collector is connected to the base and the ground potential.

When receiving the bias current Ib2 from the node N2 side, the diode 18 makes the bias current Ib2 flow to the ground potential side in the forward direction. At this time, a potential on the node N2 side of the diode 18 (≡potential of the node N2) becomes a forward voltage (for example, approximately 0.7 V) of the diode 18.

FIG. 1 illustrates a configuration in a case where the standard voltage circuit 10 has one diode 18 for the sake of simple illustration, but the standard voltage circuit 10 may include a plurality (for example, dozens) of the diodes 18. At this time, the plurality of diodes 18 may be electrically inserted in parallel with each other between the node N2 and the ground potential. Thereby, it is possible to equalize the forward voltages of the plurality of diodes 18 so as to be used as the potential on the node N2 side of the diode 18, and to reduce an influence of the variation of the forward voltage of each diode 18 on the potential of the node N2.

The resistance element 15 is electrically inserted between the node N1 and the node N2 in a line L4. One terminal of the resistance element 15 is connected to the node N1, and the other terminal is connected to the diode 18 through the node N2. A resistance value of the resistance element 15 is determined in advance so as to compensate for a temperature variation with respect to the standard voltage Vvgr output from the standard voltage circuit 10.

The dummy leak generation circuit 16 is electrically connected to the line L4. The dummy leak generation circuit 16 is connected in parallel to the resistance element 15 between the current source 14 and the diode 18. An input terminal of the dummy leak generation circuit 16 is connected to the non-inverting input terminal 11*a* and the node N1, and an output terminal thereof is connected to the node N2. The dummy leak generation circuit 16 has the same off-leakage characteristics as each of the switch circuits 23 (any one of the switch circuits 23-1 to 23-*n*) during operation at a high temperature.

Next, a configuration of the voltage dividing circuit 20 is described. The voltage dividing circuit 20 has an input node 20*a* connected to the output node 10*a* of the standard voltage circuit 10, and an output node 20*b* connected to another circuit (for example, another analog circuit).

The voltage dividing circuit 20 includes a current source 21, a plurality of resistance elements 22-1 to 22-(*n*+1), and a plurality of switch circuits 23-1 to 23-*n*. N is an integer of 2 or more.

The current source 21 is electrically inserted between a power supply node N21 and a reference node Nref in a line L21. The current source 21 has an input node electrically connected to the power supply node N21, an output node electrically connected to the reference node Nref, and a control node electrically connected to the output node 10*a* of the standard voltage circuit 10 through the line L10.

The current source 21 receives the standard voltage Vvgr from the standard voltage circuit 10 and generates a reference current Iref according to the standard voltage Vvgr. The current source 21 has, for example, a transistor M21, and generates a drain current of the transistor M21 as a reference current Iref in accordance with the bias voltage received at a gate of the transistor M21. The current source 21 supplies the generated reference current Iref to the reference node Nref. The reference node Nref has a reference voltage Vref.

The resistance element 22-1 is electrically inserted between the reference node Nref in a line L21 and the resistance element 22-2. One terminal of the resistance element 22-1 is connected to the reference node Nref, and the other terminal thereof is connected to the resistance element 22-2 and the switch circuit 23-1.

The resistance element 22-2 is electrically inserted between the resistance element 22-1 and the resistance element 22-3 in the line L21. One terminal of the resistance element 22-2 is connected to the resistance element 22-1, and the other terminal thereof is connected to the resistance element 22-3 and the switch circuit 23-2.

The resistance element 22-*n* is electrically inserted between the resistance element 22-(*n*−1) (not shown) and the resistance element 22-(*n*+1) in the line L21. One terminal of the resistance element 22-*n* is connected to the resistance element 22-(*n*−1), and the other terminal thereof is connected to the resistance element 22-(*n*+1) and the switch circuit 23-*n*.

The resistance element 22-(*n*+1) is electrically inserted between the resistance element 22-*n* in the line L21 and the ground potential. One terminal of the resistance element 22-(*n*+1) is connected to the resistance element 22-*n* and the switch circuit 23-*n*, and the other terminal thereof is connected to the ground potential.

The switch circuit 23-1 is electrically inserted between the resistance elements 22-1 and 22-2 and the output node 20*b* of the voltage dividing circuit 20. An input terminal of the switch circuit 23-1 is connected to the other terminal of the resistance element 22-1 and one terminal of the resistance element 22-2, and an output terminal thereof is connected to the output node 20*b*. The switch circuit 23-1 is turned on when receiving the control signal ϕCTR-1 having an active level from the outside at a control terminal thereof and is turned off when receiving the control signal ϕCTR-1 having an inactive level from the outside at the control terminal.

The switch circuit 23-2 is electrically inserted between the resistance elements 22-2 and 22-3 and the output node 20*b* of the voltage dividing circuit 20. The switch circuit 23-2 has an input terminal connected to the other terminal of the resistance element 22-2 and one terminal of the resistance element 22-3, and an output terminal connected to the output node 20*b*. The switch circuit 23-2 is turned on when receiving the control signal ϕCTR-2 having an active level from the outside at a control terminal thereof and is turned off when receiving the control signal ϕCTR-2 having an inactive level from the outside at the control terminal.

The switch circuit 23-*n* is electrically inserted between the resistance elements 22-*n* and 22-(*n*+1) and the output node 20*b* of the voltage dividing circuit 20. An input terminal of the switch circuit 23-*n* is connected to the other terminal of the resistance element 22-*n* and one terminal of the resistance element 22-(*n*+1), and an output terminal thereof is connected to the output node 20*b*. The switch circuit 23-*n* is turned on when receiving the control signal ϕCTR-n having an active level from the outside at a control terminal thereof and is turned off when receiving the control signal ϕCTR-n having an inactive level from the outside at the control terminal.

Figure 2:
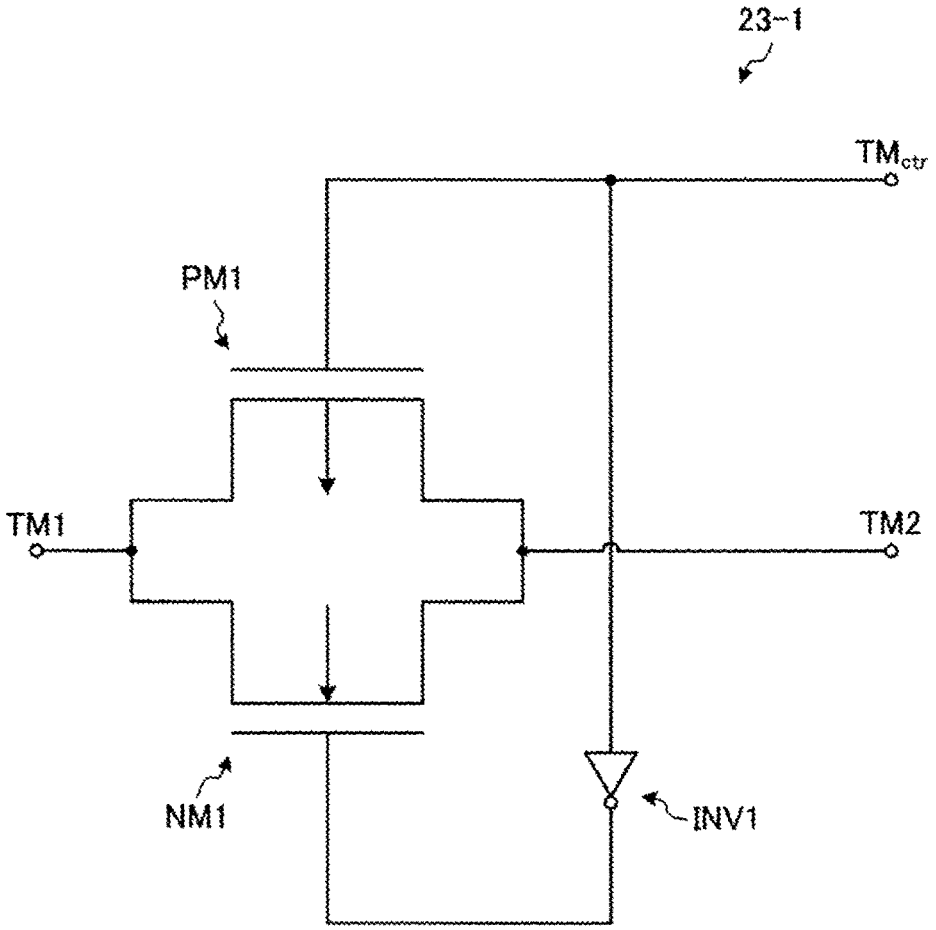
FIG. 2 is a circuit diagram illustrating a configuration of a switch circuit according to the embodiment.

Next, a configuration of each of the switch circuits 23 is described with reference to FIG. 2. FIG. 2 is a diagram illustrating a configuration of the switch circuit 23-1. In FIG. 2, the configuration of the switch circuit 23-1 is exemplarily illustrated, and configurations of the other switch circuits 23-2 to 23-*n* are also the same as the configuration of the switch circuit 23-1.

The switch circuit 23-1 has a PMOS transistor PM1, an NMOS transistor NM1, and an inverter INV1. Both a source of the PMOS transistor PM1 and a drain of the NMOS transistor NM1 are electrically connected to an input terminal TM1. Both a drain of the PMOS transistor PM1 and a source of the NMOS transistor NM1 are electrically connected to an output terminal TM2. A back gate of the PMOS transistor PM1 may be electrically connected to a back gate bias $V_{bg}$ (refer to FIG. 4). A gate of the PMOS transistor PM1 is electrically connected to a control terminal $TM_{ctr}$ and a gate of the NMOS transistor NM1 is electrically connected to the control terminal $TM_{ctr}$ through the inverter INV1.

The control signal ϕCTR-1 received by the switch circuit 23-1 at the control terminal $TM_{ctr}$ is a signal having a low active level. When the control signal ϕCTR-1 is at a low level, both the PMOS transistor PM1 and the NMOS transistor NM1 are turned on. When the control signal ϕCTR-1 is at a high level, both the PMOS transistor PM1 and the NMOS transistor NM1 are turned off.

Figure 3:
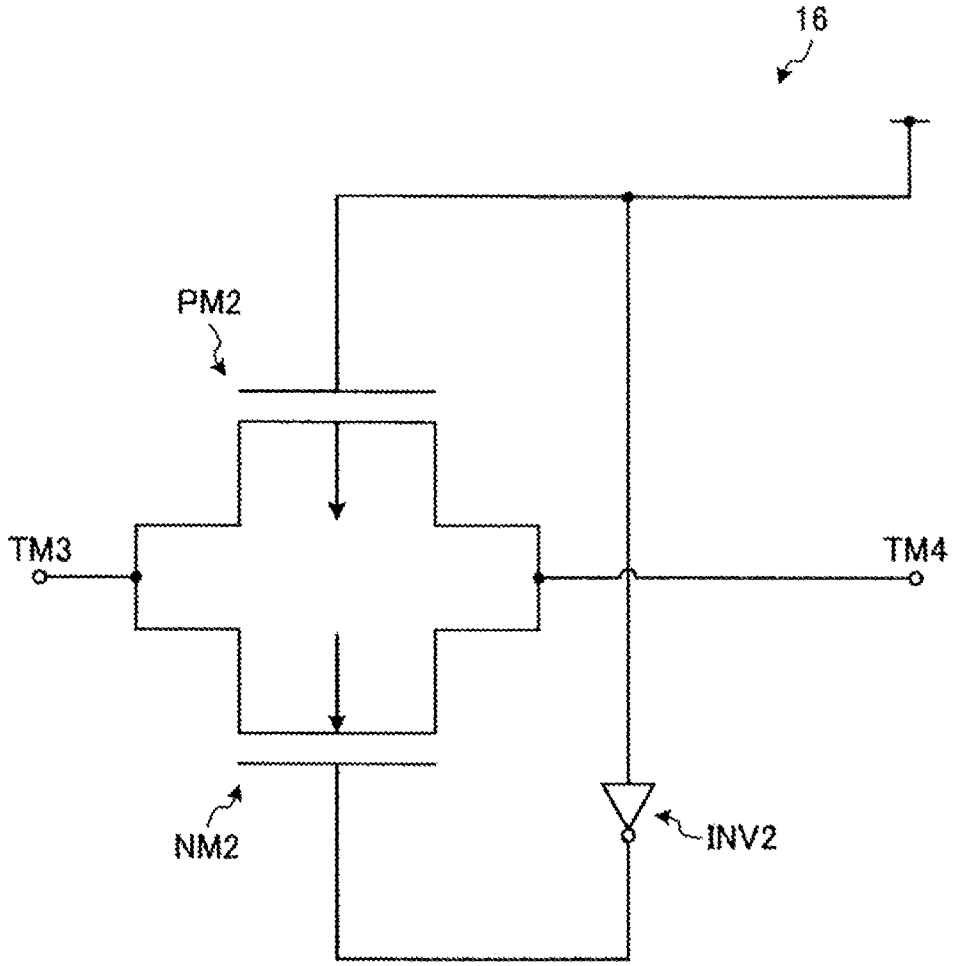
FIG. 3 is a circuit diagram illustrating a configuration of a dummy leak generation circuit according to the embodiment.

Next, a configuration of the dummy leak generation circuit 16 is described with reference to FIG. 3. FIG. 3 is a diagram illustrating the configuration of the dummy leak generation circuit 16.

As illustrated in FIG. 3, the dummy leak generation circuit 16 has a configuration corresponding to each of the switch circuits 23. The dummy leak generation circuit 16 includes a PMOS transistor PM2, an NMOS transistor NM2, and an inverter INV2. Both a source of the PMOS transistor PM2 and a drain of the NMOS transistor NM2 are electrically connected to an input terminal TM3. Both a drain of the PMOS transistor PM2 and a source of the NMOS transistor NM2 are electrically connected to an output terminal TM4. A back gate of the PMOS transistor PM2 may be electrically connected to the back gate bias $V_{bg}$ (refer to FIG. 4). A gate of the PMOS transistor PM2 is electrically connected to a power supply potential, and a gate of the NMOS transistor NM2 is electrically connected to the power supply potential through the inverter INV2. Accordingly, both the PMOS transistor PM2 and the NMOS transistor NM2 are fixed in an OFF state.

That is, the dummy leak generation circuit 16 is configured to be fixed in an OFF state, and has off-leakage characteristics corresponding to the off-leak characteristics of the switch circuit 23-1 during an operation at a high temperature.

Figure 4:
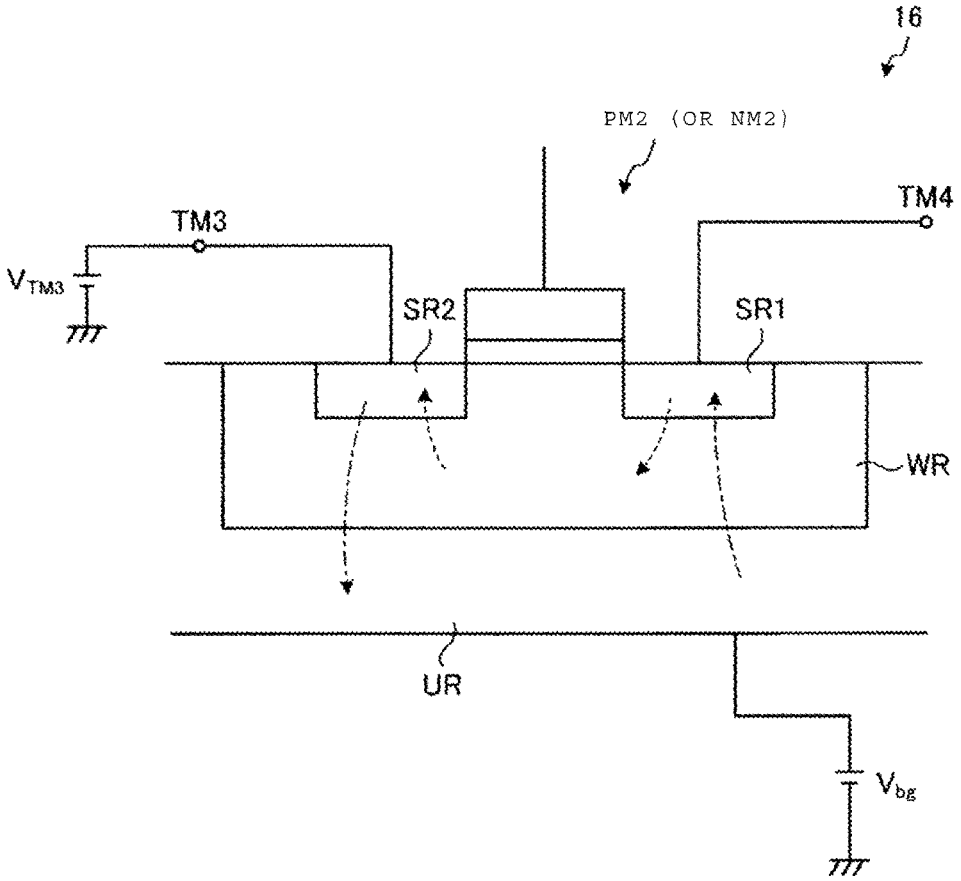
FIG. 4 is a diagram illustrating locations where leakage is generated in the dummy leak generation circuit according to the embodiment.

For example, an off-leakage denoted by an arrow of a dashed line is generated in the PMOS transistor PM2 (or the NMOS transistor NM2) in the dummy leak generation circuit 16 during an operation at a high temperature, as illustrated in FIG. 4. FIG. 4 is a diagram illustrating a location where a leakage is generated in the dummy leak generation circuit 16. In the PMOS transistor PM2, a leakage caused by charges (electrons) escaping from a semiconductor region SR1 (drain or source) electrically connected to the output terminal TM4 to a well region WR is generated, or a leakage caused by charges (electrons) escaping from the well region WR to a semiconductor region SR2 (source or drain) electrically connected to the input terminal TM3 is generated. Alternatively, in the PMOS transistor PM2 (or the NMOS transistor NM2), a leakage denoted by an arrow of a one-dotted line is generated. A leakage caused by charges (electrons) escaping from a base region UR to which the back gate bias $V_{bg}$ is applied to the semiconductor region SR1 via the well region WR is generated, or a leakage caused by charges escaping from the semiconductor region SR2 to the base region UR via the well region WR is generated.

Figure 5A:
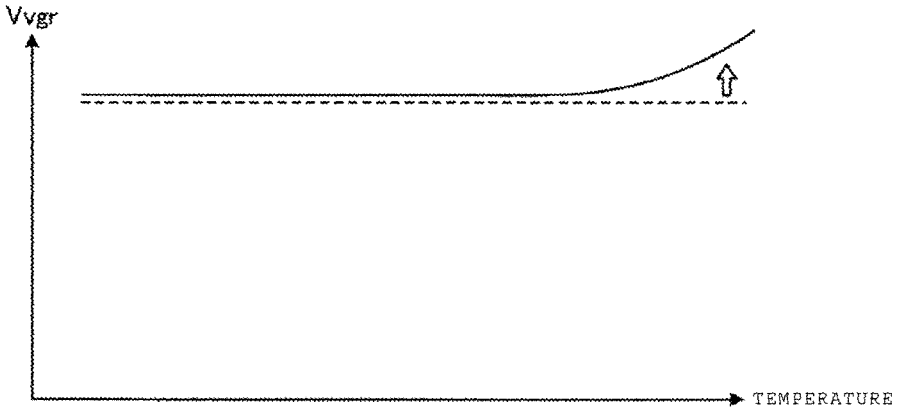
FIGS. 5A and 5B are diagrams illustrating operations of the standard voltage circuit according to the embodiment.
Figure 5B:
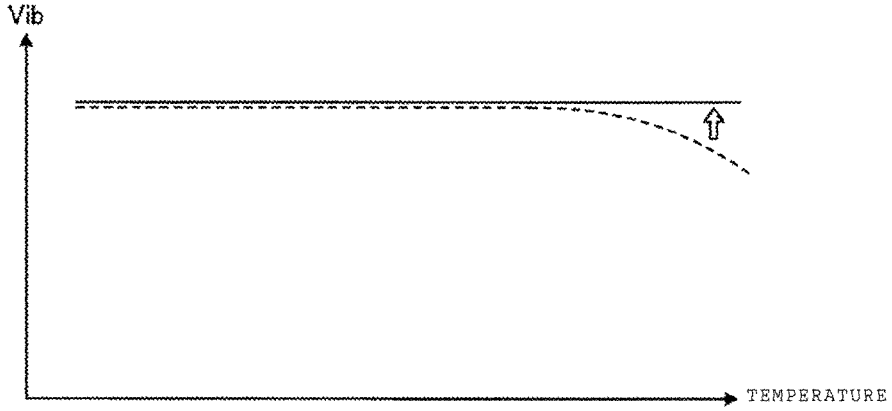

A dummy off-leakage is generated by the dummy leak generation circuit 16 in the standard voltage circuit 10 during the operation at a high temperature, and thereby, as denoted by a solid line in FIG. 5A, the standard voltage Vvgr supplied from the standard voltage circuit 10 to the voltage dividing circuit 20 has characteristics having a value increasing during the operation at a high temperature. That is, the characteristics of the standard voltage Vvgr is corrected by the dummy leak generation circuit 16 so as to be substantially opposite to characteristics of the standard voltage Vib in a case where there is no dummy leak generation circuit 16 (characteristics denoted by the dashed line in FIG. 5B). As a result, the standard voltage Vib divided by the voltage dividing circuit 20 to be output has characteristics in which temperature dependence is reduced as denoted by a solid line in FIG. 5B.

As described above, in the embodiment, in the standard voltage circuit 10 includes the dummy leak generation circuit 16 with the same off-leak characteristics as each of the switch circuits 23, and the standard voltage Vvgr changes depending on the off-leakage characteristics. Thereby, temperature variation of the standard voltage Vib output from the voltage dividing circuit 20 is easily reduced.

Figure 6:
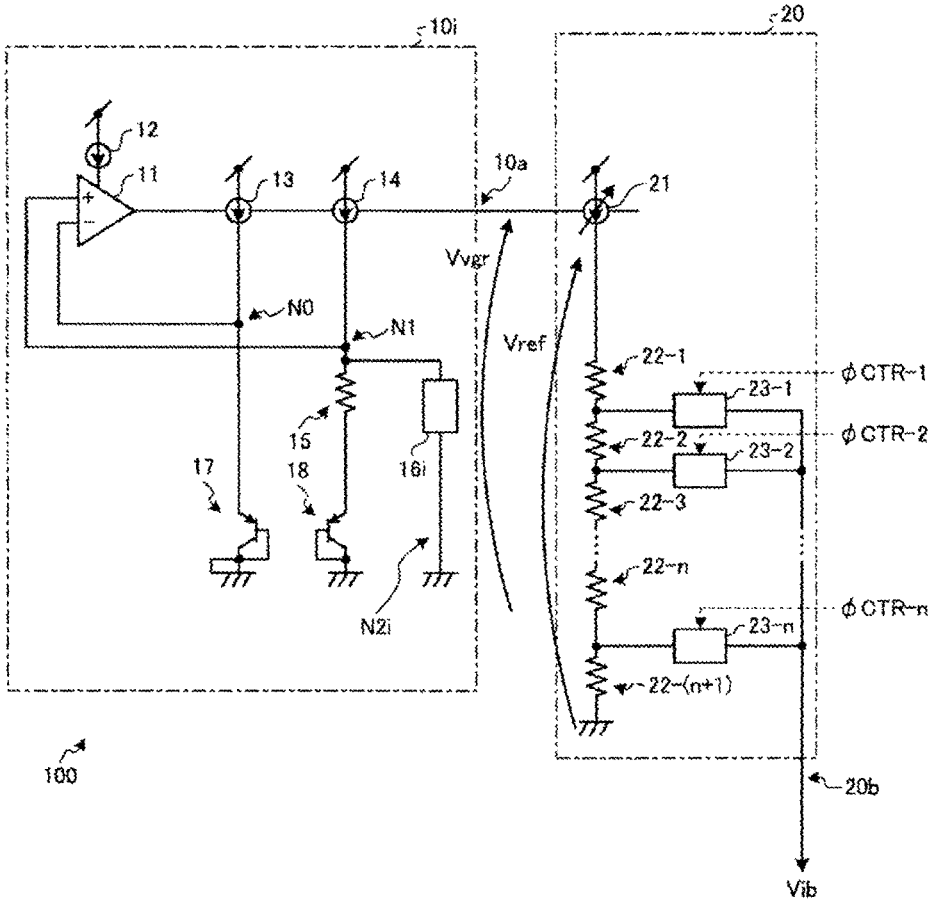
FIG. 6 is a circuit diagram illustrating a configuration of a semiconductor integrated circuit including a standard voltage circuit according to one modification example of the embodiment.

As illustrated in FIG. 6, a dummy leak generation circuit 16*i* in a standard voltage circuit 10*i* may have an output terminal connected to a node N2*i* having the ground potential instead of being connected to the node N2 (refer to FIG. 1) between the resistance element 15 and the diode 18. Even in this case, the standard voltage circuit 10*i* can perform the same operation as in the embodiment of FIG. 1.

Figure 7:
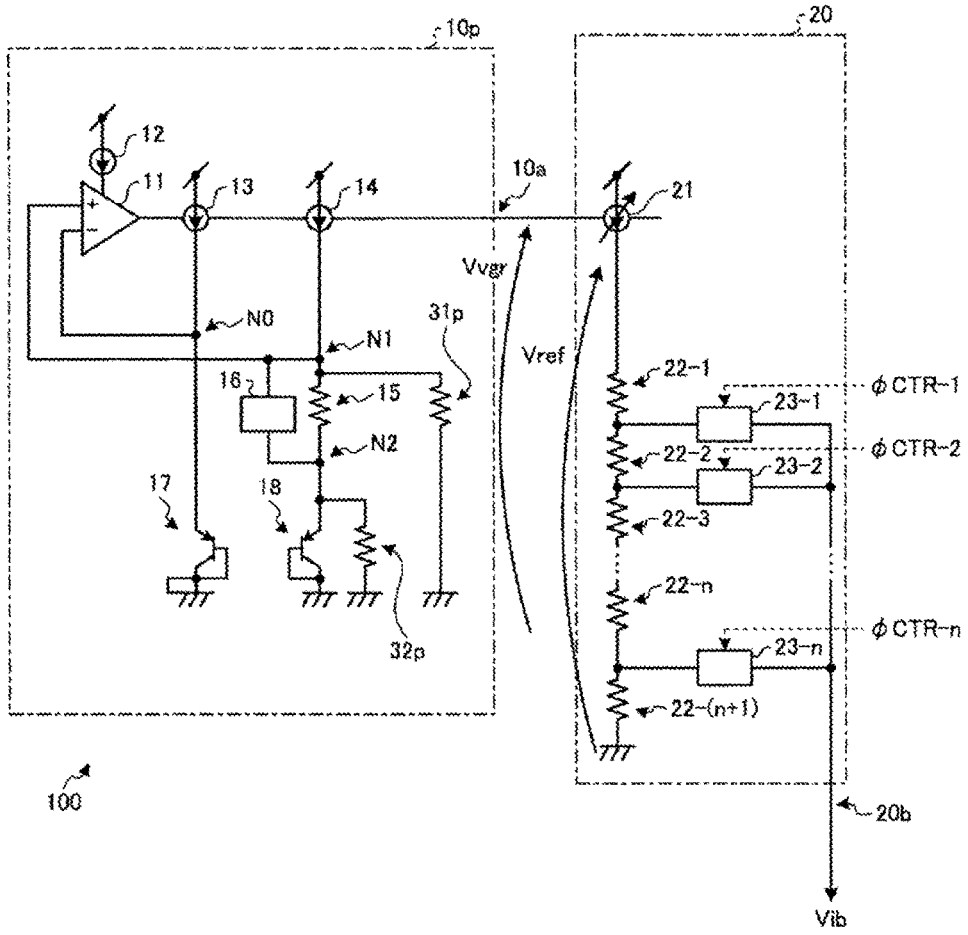
FIG. 7 is a circuit diagram illustrating a configuration of a semiconductor integrated circuit including a standard voltage circuit according to another modification example of the embodiment.

Alternately, as illustrated in FIG. 7, a resistance element 31*p* is further electrically inserted between the node N1 in a standard voltage circuit 10*p* and the ground potential, and a resistance element 32*p* may be further electrically inserted between the node N2 and the ground potential. Thereby, both a potential of the node N1 and a potential of the node N2 can be easily stabilized.

Figure 8:
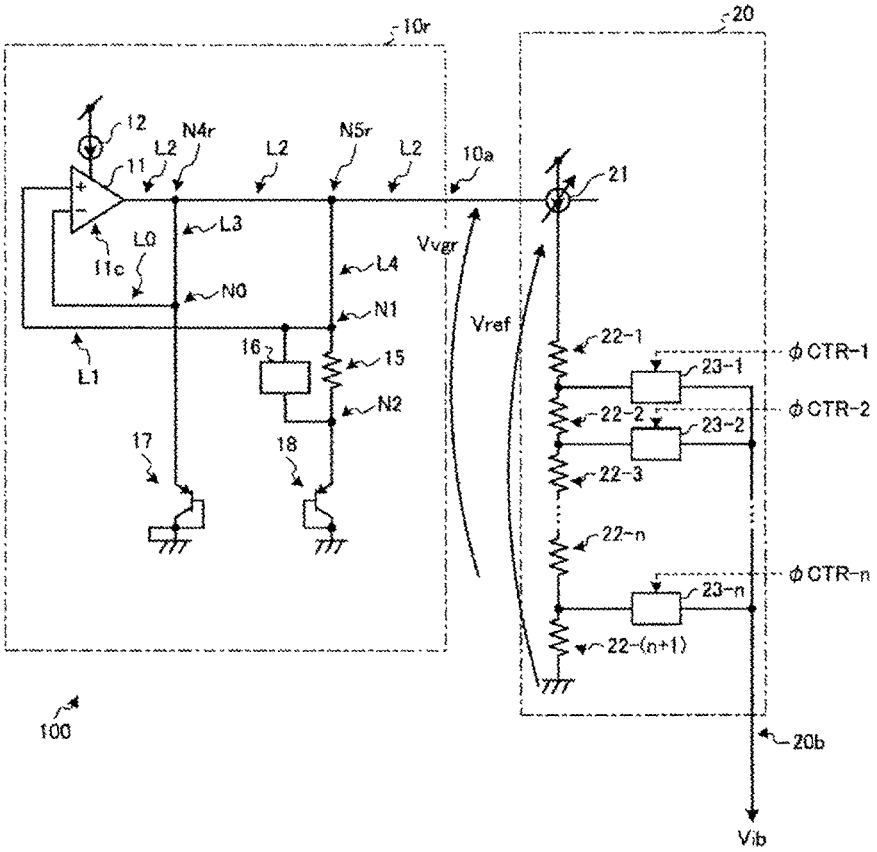
FIG. 8 is a circuit diagram illustrating a configuration of a semiconductor integrated circuit including a standard voltage circuit according to still another modification example of the embodiment.

Alternatively, as illustrated in FIG. 8, a standard voltage circuit 10*r* may have a configuration in which the current sources 13 and 14 (refer to FIG. 1) are omitted. That is, the line L3 is electrically connected to the line L2 through a node N4*r* and the line L4 is electrically connected to the line L2 through a node N5*r*. Thereby, each of a potential of the node N0 and a potential of the node N1 can have a value in accordance with a voltage of an output terminal 11*c* of the operational amplifier 11, and thereby, the same operation as in the embodiment can be performed.

Figure 9:
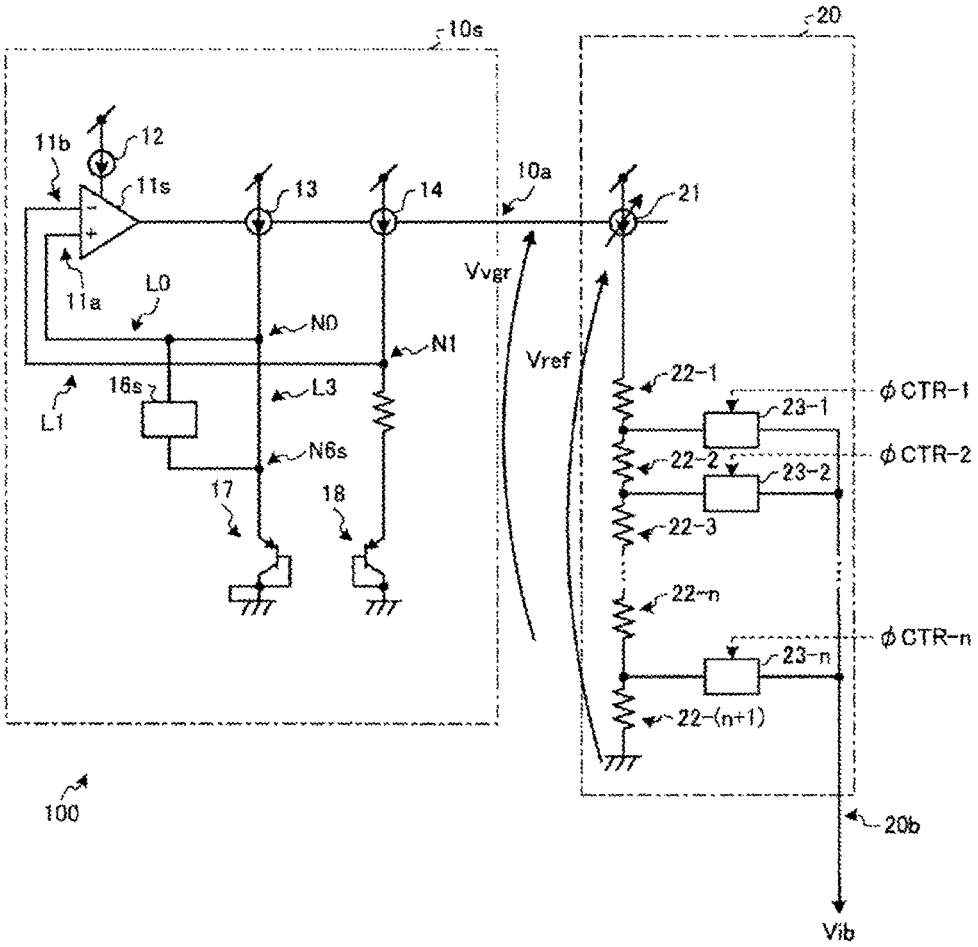
FIG. 9 is a circuit diagram illustrating a configuration of a semiconductor integrated circuit including a standard voltage circuit according to still another modification example of the embodiment.

Alternatively, as illustrated in FIG. 9, an operational amplifier 11*s* in a standard voltage circuit 10*s* may be connected to the nodes N0 and N1 in an opposite polarity, and a dummy leak generation circuit 16*s* may be electrically connected to the line L3. The inverting input terminal lib is connected to the node N1 through the line L1. The non-inverting input terminal 11*a* is connected to the node N0 through the line L0. The dummy leak generation circuit 16*s* is connected in parallel to the line L3 between the current source 13 and the diode 17. An input terminal of the dummy leak generation circuit 16*s* is connected to the non-inverting input terminal 11*a* and the node N0, and an output terminal thereof is connected to a node N6*s*. The dummy leak generation circuit 16 has the same off-leakage characteristics as the switch circuits 23-1 to 23-*n* during the operation at a high temperature. Thereby, the standard voltage circuit 10*s* can perform the same operation as in the embodiment.

Figure 10:
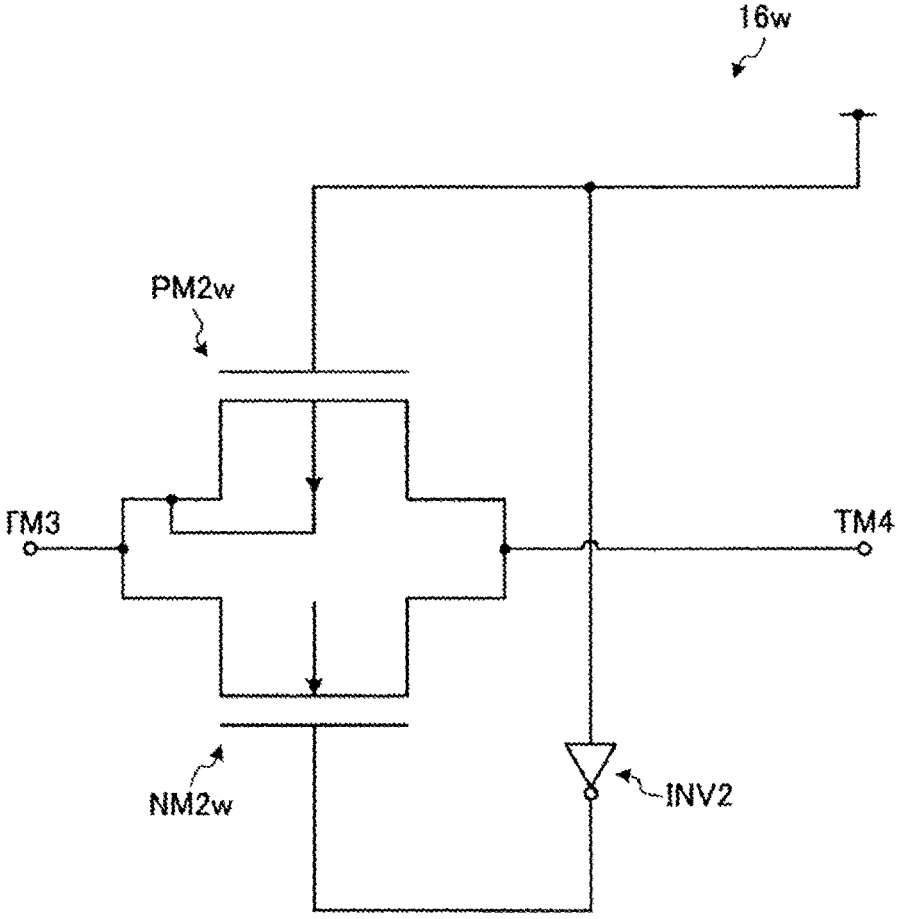
FIG. 10 is a circuit diagram illustrating a configuration of a dummy leak generation circuit according to one modification example of the embodiment.

Alternatively, as illustrated in FIG. 10, a configuration of a dummy leak generation circuit 16*w* may be a configuration in which a back gate of a PMOS transistor PM2*w* is electrically connected to a source of the PMOS transistor PM2*w*. Even with the configuration illustrated in FIG. 10, the dummy leak generation circuit 16*w* can have a configuration corresponding to each of the switch circuits 23, and can have the same off-leak characteristics as the switch circuits 23-1 to 23-*n* during the operation at a high temperature.

Figure 11:
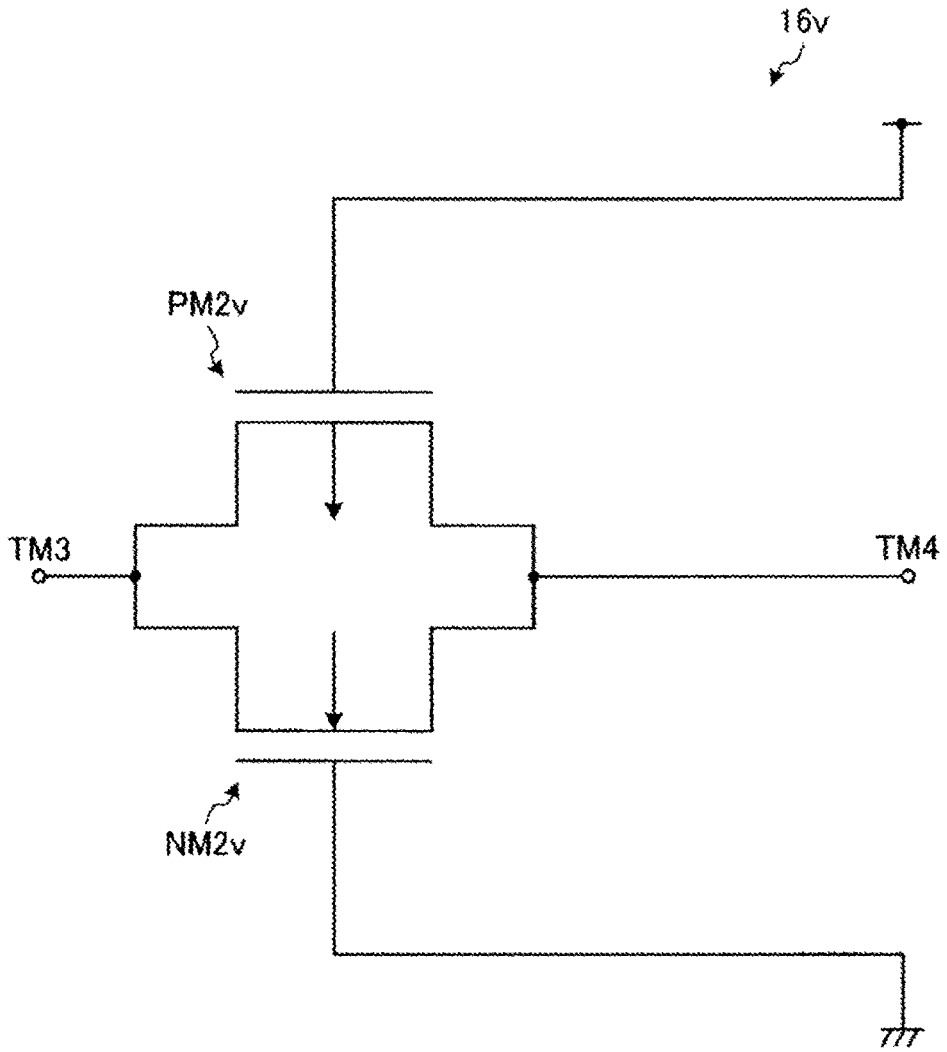
FIG. 11 is a circuit diagram illustrating a configuration of a dummy leak generation circuit according to another modification example of the embodiment.

Alternatively, as illustrated in FIG. 11, a configuration of a dummy leak generation circuit 16*v* may be a configuration in which the inverter INV2 in the configuration illustrated in FIG. 3 is omitted. That is, a gate of a PMOS transistor PM2*v* is electrically connected to the power supply potential, and a gate of an NMOS transistor NM2*v* is electrically connected to the ground potential. Thereby, both the PMOS transistor PM2*v* and the NMOS transistor NM2*v* are fixed in an OFF state. Even with the configuration illustrated in FIG. 11, the dummy leak generation circuit 16*v* has a configuration corresponding to each of the switch circuits 23, and can have the same off-leak characteristics as the switch circuits 23-1 to 23-*n* during the operation at a high temperature.

Figure 12A:
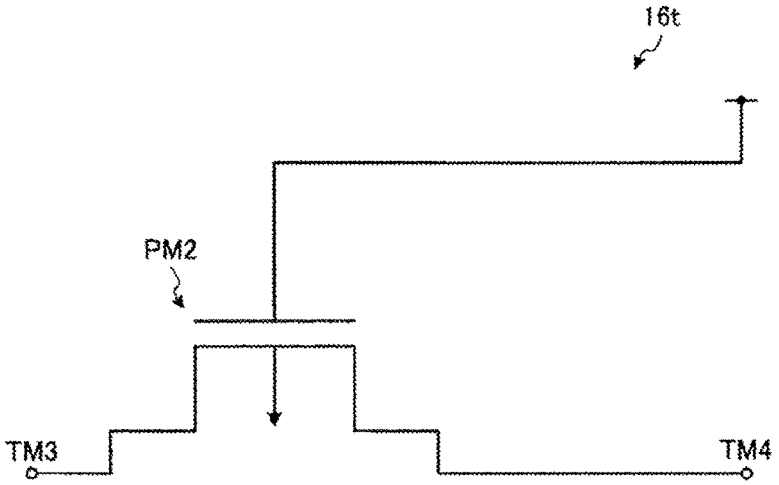
FIGS. 12A and 12B are circuit diagrams illustrating configurations of a dummy leak generation circuit according to still another modification example of the embodiment.
Figure 12B:
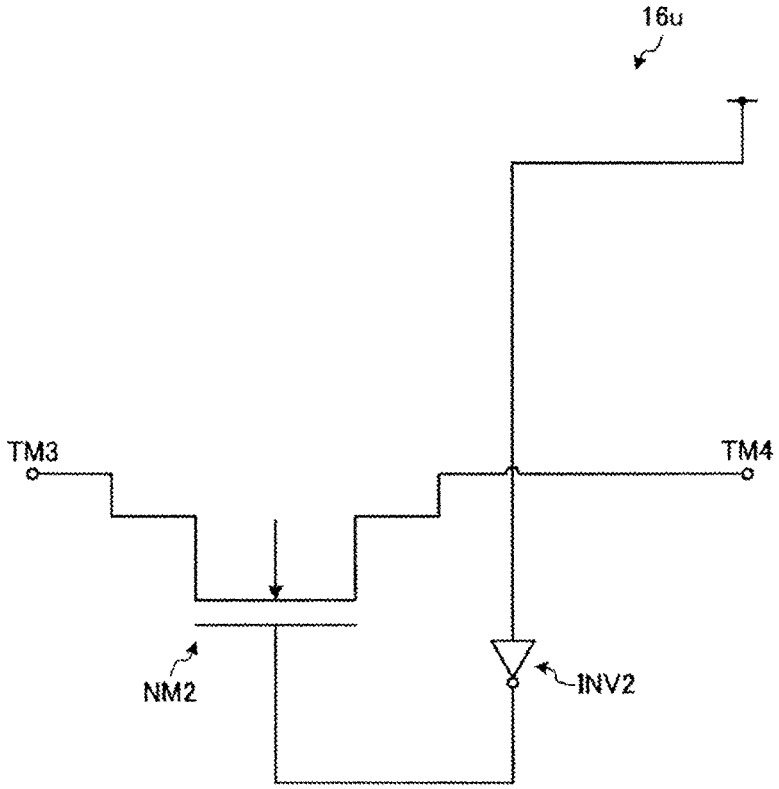

Alternatively, as illustrated in FIG. 12A, a configuration of a dummy leak generation circuit 16*t* may be a configuration in which an NMOS transistor NM2 in the configuration illustrated in FIG. 3 is omitted. Alternatively, as illustrated in FIG. 12B, a configuration of a dummy leak generation circuit 16*u* may be a configuration in which the PMOS transistor PM2 in the configuration illustrated in FIG. 3 is omitted. Even with the configurations illustrated in FIG. 12A or 12B, the dummy leak generation circuits 16*t* and 16*u* can have configurations corresponding to each of the switch circuits 23, and can have the same off-leak characteristics as the switch circuits 23-1 to 23-*n* during an operation at a high temperature.

Figure 13A:
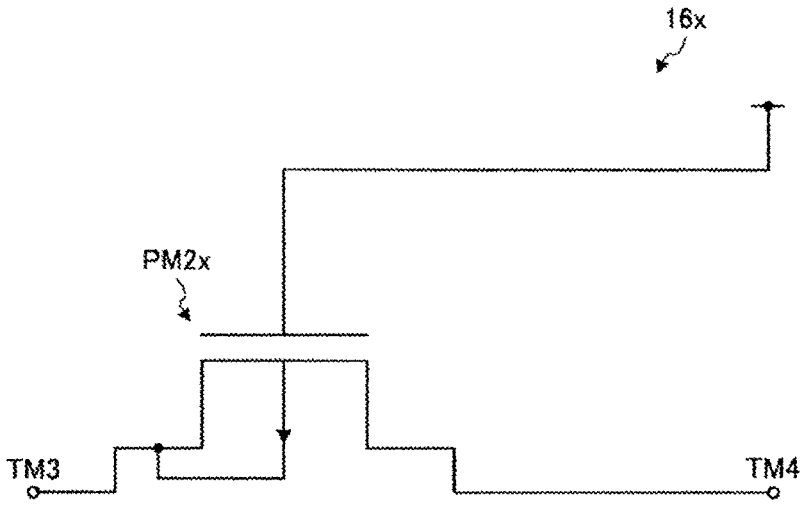
FIGS. 13A and 13B are circuit diagrams illustrating configurations of a dummy leak generation circuit according to still another modification example of the embodiment.

Alternatively, as illustrated in FIG. 13A, a configuration of a dummy leak generation circuit 16*x* may be a configuration in which the configuration illustrated in FIG. 12A is modified by electrically connecting a back gate of a PMOS transistor PM2*x* to a source of the PMOS transistor PM2*x*. Even with the configuration illustrated in FIG. 13A, the dummy leak generation circuit 16*x* has a configuration corresponding to each of the switch circuits 23, and can have the same off-leak characteristics as the switch circuits 23-1 to 23-*n* during the operation at a high temperature.

Figure 13B:
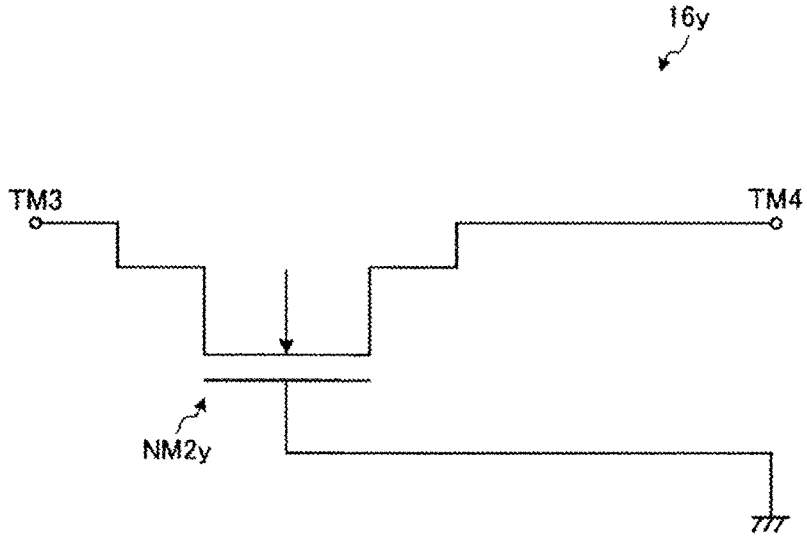

Alternatively, as illustrated in FIG. 13B, a configuration of a dummy leak generation circuit 16*y* may be a configuration in which the configuration illustrated in FIG. 12B is modified by omitting the inverter INV 2 and electrically connecting a gate of the NMOS transistor NM2 to the ground potential. That is, the gate of an NMOS transistor NM2*y* is electrically connected to the ground potential. Thereby, the NMOS transistor NM2*y* is fixed in an OFF state. Even with the configuration, the dummy leak generation circuit can have a configuration corresponding to each of the switch circuits 23, and can have the same off-leak characteristics as the switch circuits 23-1 to 23-*n* during the operation at a high temperature.

Figure 14:
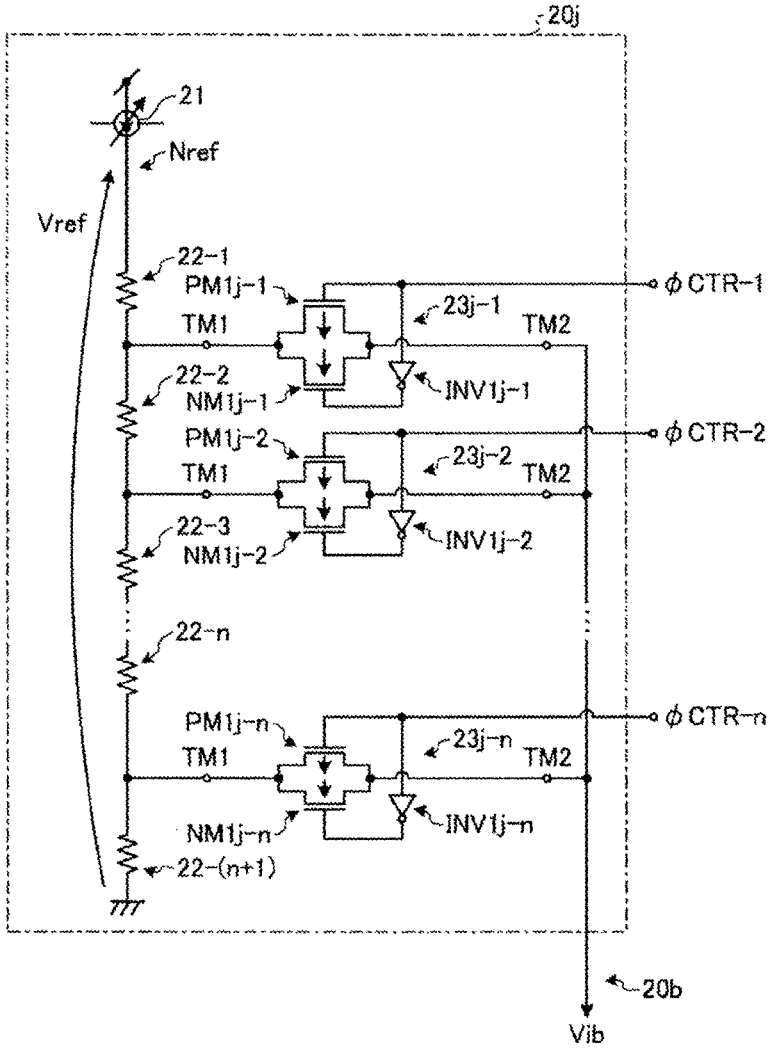
FIG. 14 is a circuit diagram illustrating a configuration of a voltage dividing circuit according to one modification example of the embodiment.

In addition, in the embodiment, a case where the plurality of switch circuits 23-1 to 23-*n* in a voltage dividing circuit 20*j* have the same configuration as each other is exemplified, but, as illustrated in FIG. 14, a plurality of switch circuits 23*j*–1, 23*j*–2, . . . , 23*j*–n may have different configurations from each other. For example, dimensions (=W/L, W: a width of a gate, L: a length of the gate) of PMOS transistors PM1*j*–1, PM1*j*–2, . . . , PM1*j*–n in the switch circuits 23*j*–1, 23*j*–2, . . . , 23*j*–n may be configured to be selectively reduced in this order. At this time, dimensions (=W/L, W: a width of a gate, L: a length of the gate) of NMOS transistors NM1*j*–1, NM1*j*–2, . . . , NM1*j*–n in the switch circuits 23*j*–1, 23*j*–2, . . . , 23*j*–n may be equal to each other. In addition, inverters INV1*j*–1, INV1*j*–2, . . . , INV1*j*–n in the switch circuits 23*j*–1, 23*j*–2, . . . , 23*j*–n may have the same configuration as each other. Thereby, when the voltage dividing circuit 20*j* divides a voltage into voltages of a plurality of steps, step widths of the respective divided voltage values can be equalized. At this time, the configuration of the dummy leak generation circuit 16 may correspond to a configuration of an intermediate switch circuit 23*j*–*x* (x is an integer part of a value obtained by dividing n by 2, or a value obtained by adding 1 to the integer part).

Figure 15:
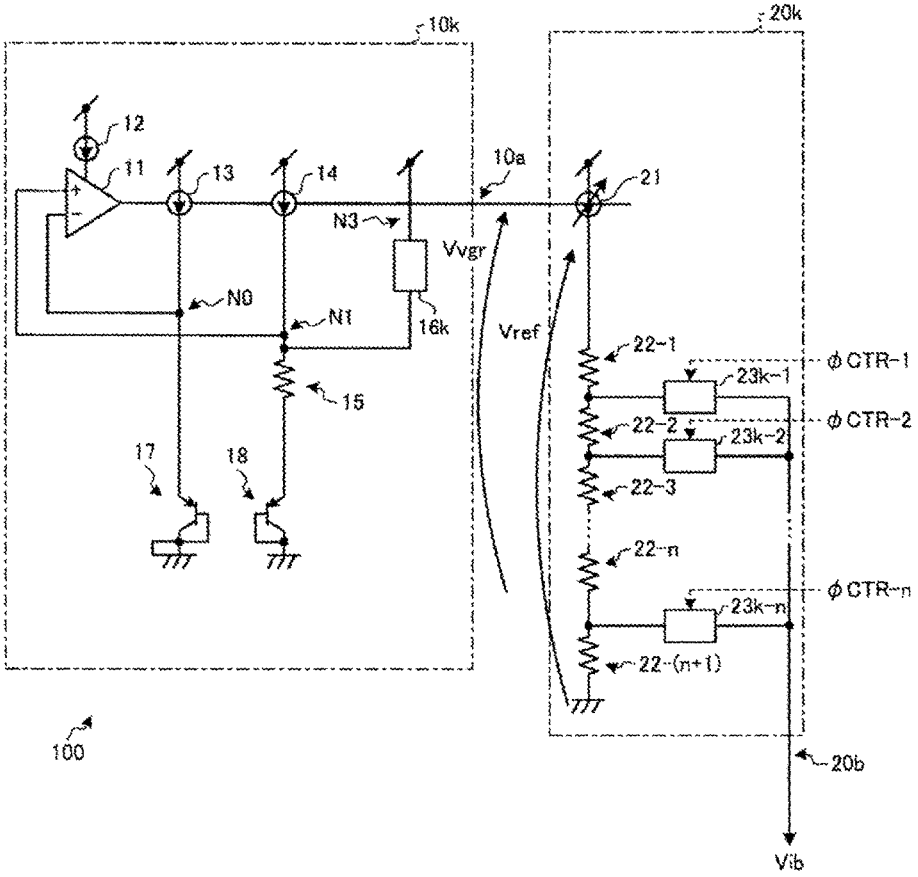
FIG. 15 is a circuit diagram illustrating a configuration of a semiconductor integrated circuit including a standard voltage circuit according to still another modification example of the embodiment.
Figure 16A:
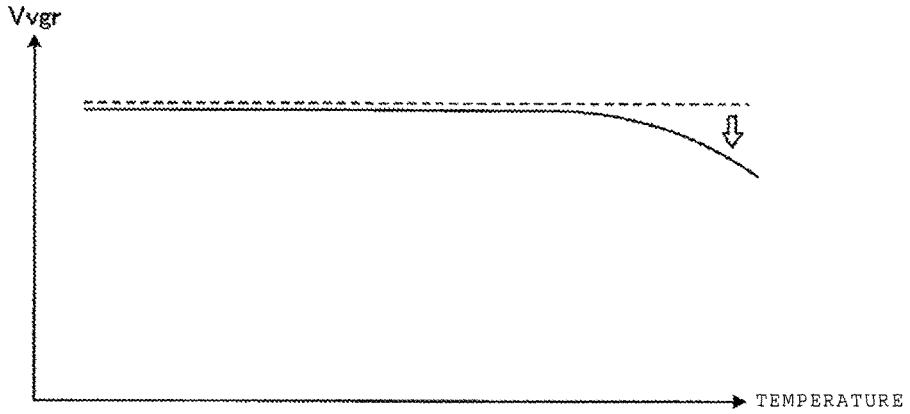
FIGS. 16A and 16B are circuit diagrams illustrating operations of the standard voltage circuit according to the still another modification example of the embodiment.
Figure 16B:
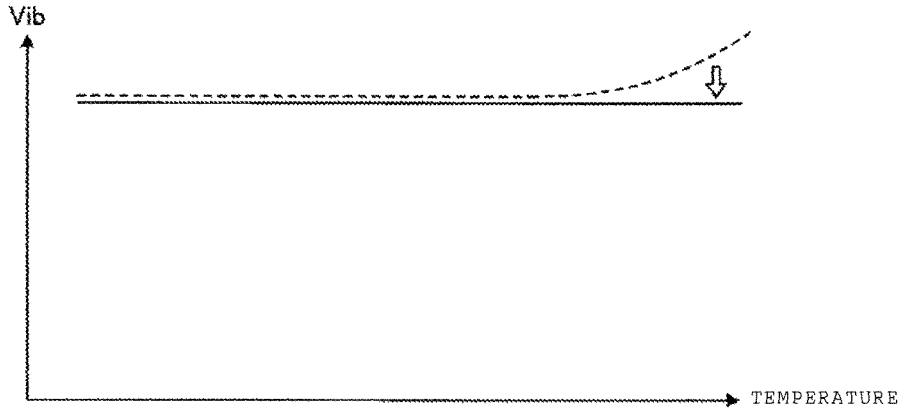

Alternatively, in a case where the standard voltage Vib varies in an upward direction as denoted by a dashed line in FIG. 16B due to an off-leakage of switch circuits 23*k*–1 to 23*k*–n in a voltage dividing circuit 20*k* illustrated in FIG. 15 during an operation at a high temperature, a dummy leak generation circuit 16*k* in a standard voltage circuit 10*k* may be connected to the node N3 having the power supply potential in the same manner as the output terminal.

The standard voltage Vvgr supplied from the standard voltage circuit 10*k* to the voltage dividing circuit 20*k* has characteristics in which a value decreases during an operation at a high temperature due to an off-leakage generated by the dummy leak generation circuit 16*k* in the standard voltage circuit 10*k* during the operation at a high temperature as denoted by a solid line in FIG. 16A. That is, the characteristics of the standard voltage Vvgr are corrected by the dummy leak generation circuit 16*k* so as to be substantially opposite to the characteristics of the standard voltage Vib (characteristics denoted by a dashed line in FIG. 16B) in a case where there is no dummy leak generation circuit 16*k*. As a result, the standard voltage Vib divided by the voltage dividing circuit 20*k* to be output has characteristics in which temperature dependence is reduced as denoted by a solid line in FIG. 16B.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A standard voltage circuit comprising:

an operational amplifier that includes a first input terminal, a second input terminal, and an output terminal;

a first diode that is electrically connected to the first input terminal through a first node of a first line that receives an output signal from the output terminal;

a second diode that is electrically connected to the second input terminal through a second node of a second line that receives the output signal from the output terminal;

a resistance element that is electrically connected to the second node in series with the second diode; and a dummy leak generation circuit that is electrically connected to one of the first line and the second line and configured as a switch including:

a PMOS transistor having a gate, a source, and a drain;

an NMOS transistor having a gate, a source, and a drain, the source and the drain of the PMOS transistor being connected to the drain and the source of the NMOS transistor, respectively; and an inverter having an input connected to one of the gates of the PMOS and NMOS transistors and an output connected to the other of the gates of the PMOS and NMOS transistors, the input of the inverter being connected to a power supply reference potential.

2. The standard voltage circuit according to claim 1, wherein the dummy leak generation circuit has a first terminal electrically connected to the second node and a second terminal electrically connected to a third node between the resistance element and the second diode.

3. The standard voltage circuit according to claim 2, further comprising:

another resistance element electrically connected between the third node and a ground reference potential.

4. The standard voltage circuit according to claim 1, wherein the dummy leak generation circuit has a first terminal electrically connected to the second node of the second line and a second terminal electrically connected to a ground reference potential.

5. The standard voltage circuit according to claim 1, wherein the dummy leak generation circuit has a first terminal electrically connected to the second node of the second line and a second terminal electrically connected to a power supply reference potential.

6. The standard voltage circuit according to claim 1, wherein the dummy leak generation circuit has a first terminal electrically connected to the first node and a second terminal connected to a third node between the first node and the first diode.

7. The standard voltage circuit according to claim 1, further comprising:

a first current source electrically connected between a power supply reference potential and the first node and having a control node which is connected to the output terminal; and a second current source electrically connected between the power supply reference potential and the first node and having a control node which is connected to the output terminal.

8. A semiconductor integrated circuit comprising:

a voltage dividing circuit that has a switch circuit; and a standard voltage circuit connected to the voltage dividing circuit, wherein the standard voltage circuit includes:

an operational amplifier that includes a first input terminal, a second input terminal, and an output terminal;

a first diode that is electrically connected to the first input terminal through a first node of a first line that receives an output signal from the output terminal;

a second diode that is electrically connected to the second input terminal through a second node of a second line that receives the output signal from the output terminal;

a resistance element that is electrically connected to the second node in series with the second diode; and a dummy leak generation circuit that is electrically connected to one of the first line and the second line and configured as a switch including:

a PMOS transistor having a gate, a source, and a drain;

an NMOS transistor having a gate, a source, and a drain, the source and the drain of the PMOS transistor being connected to the drain and the source of the NMOS transistor, respectively; and an inverter having an input connected to one of the gates of the PMOS and NMOS transistors and an output connected to the other of the gates of the PMOS and NMOS transistors, the input of the inverter being connected to a power supply reference potential, and wherein the dummy leak generation circuit of the standard voltage circuit has a configuration corresponding to a configuration of the switch circuit.

9. A voltage reference circuit comprising:

a resistance element having a first end and a second end;

a dummy leak generation circuit;

an operational amplifier having a first input, a second input, and an output;

a first diode;

a second diode connected to the second end of the resistance element;

a first line having a first end connected to the first diode and a second end connected to the first input of the operational amplifier;

a second line having a first end connected to the second diode and a second end connected to the second input of the operational amplifier;

a third line connected at a first end to a node on the first line; and a fourth line connected at one end to the first end of the resistance element, wherein the output of the operational amplifier is connected to control nodes of current sources that supply current to the first and second diodes via the third line and the fourth line, respectively, wherein the dummy leak generation circuit has an end that is coupled to one of the first and second inputs of the operational amplifier via the second line, and wherein the dummy leak generation circuit is configured as a switch including:

a PMOS transistor having a gate, a source, and a drain; and an NMOS transistor having a gate, a source, and a drain, the source and the drain of the PMOS transistor being connected to the drain and the source of the NMOS transistor, respectively, the gate of the PMOS transistor being connected to a power supply reference potential, and the gate of the NMOS transistor being connected to a ground reference potential.

10. The voltage reference circuit according to claim 9, wherein the first and second diodes are configured as diode-connected transistors.

11. The voltage reference circuit according to claim 10, wherein the diode-connected transistors are pnp bipolar transistors.

12. The voltage reference circuit according to claim 9, wherein the first and second diodes are configured as a plurality of diodes.

13. The voltage reference circuit according to claim 9, wherein the dummy leak generation circuit provides a leakage characteristic that matches a switch in a voltage divider circuit coupled to the voltage reference circuit.

14. The voltage reference circuit according to claim 9, wherein the dummy leak generation circuit has an end connected to a ground reference potential.

15. The voltage reference circuit according to claim 9, wherein the dummy leak generation circuit has an end connected to a power supply reference potential.

16. The voltage reference circuit according to claim 9, further comprising:

a first resistor and a second resistor, the first resistor being connected to the first end of the resistance element and a ground reference potential, and the second resistor being connected to the second end of the resistance element and a ground reference potential.

* * * * *